US007824454B2

(12) United States Patent
Moore

(10) Patent No.: US 7,824,454 B2
(45) Date of Patent: Nov. 2, 2010

(54) FUEL COMPOSITION FOR RECTIFYING FUEL GAUGE SENDING UNIT PROBLEMS

(75) Inventor: Stephen M. Moore, Woodacre, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 856 days.

(21) Appl. No.: 10/920,491

(22) Filed: Aug. 17, 2004

(65) Prior Publication Data

US 2006/0037234 A1 Feb. 23, 2006

(51) Int. Cl.
*C10L 10/18* (2006.01)
*C10L 1/228* (2006.01)

(52) U.S. Cl. ..... 44/443; 44/342; 44/424; 44/434

(58) Field of Classification Search ..... 44/443, 44/434, 424, 342
See application file for complete search history.

(56) References Cited

U.S. PATENT DOCUMENTS

| | | | | | |
|---|---|---|---|---|---|
| 2,719,125 | A | * | 9/1955 | Roberts | 508/273 |
| 3,663,561 | A | | 5/1972 | Blaha | |
| 4,191,537 | A | | 3/1980 | Lewis et al. | |
| 5,089,029 | A | * | 2/1992 | Hashimoto et al. | 44/432 |
| 5,112,364 | A | | 5/1992 | Rath et al. | |
| 5,538,652 | A | * | 7/1996 | Farng et al. | 508/231 |
| 5,653,787 | A | | 8/1997 | Poirier | |
| 5,752,991 | A | | 5/1998 | Plavac | |
| 5,851,242 | A | | 12/1998 | Cherpeck et al. | |
| 5,853,435 | A | | 12/1998 | Avery et al. | |
| 5,888,255 | A | | 3/1999 | Poirier | |

FOREIGN PATENT DOCUMENTS

| | | |
|---|---|---|
| CA | 2174171 | 6/2003 |
| WO | WO 96/06903 | 3/1996 |
| WO | WO 00/49109 | 8/2000 |
| WO | WO 02/31449 A1 | 4/2002 |
| WO | WO 03/078553 A2 | 9/2003 |

* cited by examiner

*Primary Examiner*—Glenn A Caldarola
*Assistant Examiner*—Pamela Weiss
(74) *Attorney, Agent, or Firm*—Jones Day

(57) ABSTRACT

A unique combination of a certain poly(oxyalkylene) amine and a thiadiazole compound when employed as a fuel additive in a hydrocarbon fuel such as gasoline or diesel fuel will preclude fuel gauge sending units from sustaining sulfur-related corrosion damage or restore fuel gauge sending units, particularly silver-based fuel gauge sending units, in vehicle fuel storage tanks to like-new operational condition. Moreover, a method suitable for use in precluding fuel gauge sending units from sustaining sulfur-related corrosion damage or restoring silver-based fuel gauge sending units in gasoline or diesel vehicle fuel storage tanks to like-new operational condition using the combination of a certain poly (oxyalkylene) amine and a thiadiazole compound as a fuel additive is also described.

17 Claims, No Drawings

FUEL COMPOSITION FOR RECTIFYING FUEL GAUGE SENDING UNIT PROBLEMS

The present invention relates to a fuel composition for gasoline or diesel vehicles. More particularly, the present invention relates to a fuel composition effective at rectifying fuel gauge sending unit problems in fuel storage tanks of vehicles operated on gasoline or diesel fuels, such as passenger cars and light trucks.

BACKGROUND OF THE INVENTION

Harmful sulfurs (elemental and mercaptans) found in many current marketplace gasolines have been shown to induce failure in silver-based fuel gauge sending unit components; these sending unit components are typically mounted in the vehicle's fuel storage tank and are exposed directly to gasoline. Sulfur induces a corrosive film on critical electrical components of the fuel gauge sending unit that disrupts electrical continuity and leads to either erratic operation or complete failure of the sending unit. On many fuel gauge sending unit designs, the erratic operation or failure can give an artificially high level reading on the vehicle's instrument cluster fuel gauge (seen by the driver); this can lead to the vehicle inadvertently running out of fuel, which has serious safety implications under many driving conditions.

Production fuel gauge sending units typically consist of two key electrical components that can be susceptible to sulfur corrosion; a resistive grid element affixed to a ceramic substrate and a contact wiper element that mechanically moves over the resistive grid surface with changes in the fuel level of the storage tank. Because of the design circuit bias, the variable resistance with fuel level changes is seen as a variable voltage which ultimately is shown as movement on the vehicle's fuel gauge as seen by the driver. Increasing resistance of the sending unit is seen as increasing voltage, and decreasing resistance is seen as decreasing voltage. The increased voltage correlates with the increased fuel level in the fuel storage tank which corresponds to the level of the fuel gauge seen by the driver on the instrument panel of the vehicle.

The problem has led to a rash of warranty repair claims at dealerships. Most automotive Original Equipment Manufacturers (OEM) appear to have experienced the problem at some point. The problem typically requires the complete replacement of the fuel gauge sending unit at considerable expense to the OEM or the vehicle owner. Some OEMs have moved towards replacing the silver-based components of the sending units with gold-alloy components. While this is a solution to the problem, it is very expensive and undesireable. Because the silver-based components were first introduced into the marketplace in 1988, over 15 years of manufactured vehicles are still susceptible to the problem.

Metal-filming additives by themselves have been added to bulk gasoline in refineries and in distribution terminals in an attempt to correct abnormally severe batches of gasoline before they reach the marketplace. This is a very expensive procedure and has limited effectiveness because much of the metal filmer additive is lost to the walls of the fuel distribution system before it ever reaches the vehicle's fuel tank. The ideal delivery method for a corrosion inhibitor filming agent is by addition to an aftermarket concentrate package, whereby the package is poured directly into the vehicle's fuel tank and mixed with the gasoline.

Polyether amine fuel additives are well known in the art for the prevention and control of carbonaceous engine deposits.

These polyether additives have a poly(oxyalkylene) "backbone", i.e., the polyether portion of the molecule consists of repeating oxyalkylene units. U.S. Pat. No. 4,191,537, issued Mar. 4, 1980 to Lewis et al., for example, discloses a fuel composition comprising a major portion of hydrocarbons boiling in the gasoline range and from 30 to 2000 ppm of a hydrocarbyl poly(oxyalkylene) aminocarbamate having a molecular weight from about 600 to 10000, and at least one basic nitrogen atom. The hydrocarbyl poly(oxyalkylene) moiety is composed of oxyalkylene units having from 2 to 5 carbon atoms in each oxyalkylene unit. These fuel compositions are taught to maintain the cleanliness of intake systems without contributing to combustion chamber deposits. However, there is nothing in the disclosure to suggest that sulfur-related corrosion problems on silver-based fuel gauge sending units can be rectified at concentrations taught in the disclosure.

U.S. Pat. No. 5,851,242, issued Dec. 22, 1998 to Cherpeck et al., discloses fuel additive compositions containing a polyalkylphenoxyaminoalkane and poly(oxyalkylene) amine that is useful for the prevention and control of engine deposits.

U.S. Pat. No. 5,112,364, issued May 12, 1992 to Rath et al., discloses gasoline-engine fuels which contain from 10 to 2000 parts per million by weight of a polyetheramine and/or a polyetheramine derivative, wherein the polyetheramine is prepared by reductive amination of a phenol-initiated or alkylphenol-initiated polyether alcohol with ammonia or a primary amine U.S. Pat. No. 5,752,991 issued May 19, 1998 to Plavac, discloses fuel compositions containing from about 50 to about 2500 parts per million by weight of a long chain alkylphenyl poly(oxyalkylene) amine, wherein the alkyl substituent on the phenyl ring has at least 40 carbon atoms.

U.S. Pat. No. 5,853,435 issued Dec. 29, 1998 to Avery et al, discloses a fuel composition containing a multifunctional anti-wear, corrosion inhibiting effective amount of a polymeric amine-heterocyclic additive prepared by the reaction of a hydrocarbyl amine and a sulfur-containing heterocyclic hydrocarbyl compound in a liquid hydrocarbon combustible fuel has excellent high temperature decomposing, cleanliness and detergency/dispersancy features.

While these references primarily deal with prevention and control of carbonaceous engine deposits, they do not address the problem associated with sulfur-related corrosion damage to silver-based fuel gauge sending units.

SUMMARY OF THE INVENTION

The present invention relates to a fuel composition effective at rectifying fuel gauge sending unit problems, particularly silver-based fuel gauge sending units, in fuel storage tanks of vehicles operated on gasoline or diesel fuels, such as passenger cars and light trucks.

More particularly, it has been discovered that high concentrations of a combination of a poly(oxyalkylene) amine and a thiadiazole compound when added to a hydrocarbon fuel such as gasoline or diesel fuel will preclude fuel gauge sending units from sustaining sulfur-related corrosion damage or restore fuel gauge sending units to like-new operational condition. This is particularly surprising since the present combination of poly(oxyalkylene) amine and thiadiazole compound has been found to be significantly more effective in restoring the fuel gauge sending unit to like-new operational condition than either of these components by itself.

Accordingly, in its broadest aspect, the present invention relates to a fuel composition comprising a major amount of hydrocarbons boiling in the gasoline or diesel range and a fuel additive composition comprising:

a) at least 2000 ppm by weight of a poly(oxyalkylene) amine having at least one basic nitrogen atom and a sufficient number of oxyalkylene units to render the poly(oxyalkylene) amine soluble in hydrocarbons boiling in the gasoline or diesel fuel range and b) at least 10 ppm by weight of a thiadiazole compound.

The present invention also relates to a method of precluding silver-based fuel gauge sending units from sustaining sulfur-related corrosion damage or restoring silver-based fuel gauge sending units in gasoline or diesel vehicle fuel storage tanks to like-new operational condition. The method comprises operating a gasoline or diesel engine vehicle with a fuel composition comprising a major amount of hydrocarbons boiling in the gasoline or diesel range and a fuel additive composition comprising:

a) at least 2000 ppm by weight of a poly(oxyalkylene) amine having at least one basic nitrogen atom and a sufficient number of oxyalkylene units to render the poly(oxyalkylene) amine soluble in hydrocarbons boiling in the gasoline or diesel fuel range and b) at least 10 ppm by weight of a thiadiazole compound.

Among other factors, the present invention is based on the surprising discovery that a high concentration of a unique combination of a certain poly(oxyalkylene) amine and a thiadiazole compound when employed as a fuel additive in a hydrocarbon fuel such as gasoline or diesel fuel will preclude fuel gauge sending units from sustaining sulfur-related corrosion damage or restore fuel gauge sending units, particularly silver-based fuel gauge sending units, in vehicle fuel storage tanks to like-new operational condition. Moreover, the method of the present invention is suitable for use in precluding fuel gauge sending units from sustaining sulfur-related corrosion damage or restoring silver-based fuel gauge sending units in gasoline or diesel vehicle fuel storage tanks to like-new operational condition.

DETAILED DESCRIPTION OF THE INVENTION

As stated above, the present invention relates to a fuel composition having a high concentration of a combination of a poly(oxyalkylene) amine and a thiadiazole compound for use in vehicle fuel storage tanks to either preclude fuel gauge sending units from sustaining sulfur-related corrosion damage or restore fuel gauge sending units to like-new operational condition.

Prior to discussing the present invention in detail, the following terms will have the following meanings unless expressly stated to the contrary.

Definitions

The term "amino" refers to the group: —$NH_2$.

The term "hydrocarbyl" refers to an organic radical primarily composed of carbon and hydrogen which may be aliphatic, alicyclic, aromatic or combinations thereof, e.g., aralkyl or alkaryl. Such hydrocarbyl groups may also contain aliphatic unsaturation, i.e., olefinic or acetylenic unsaturation, and may contain minor amounts of heteroatoms, such as oxygen or nitrogen, or halogens, such as chlorine. When used in conjunction with carboxylic fatty acids, hydrocarbyl will also include olefinic unsaturation.

The term "alkyl" refers to both straight- and branched-chain alkyl groups.

The term "ppm/w" refers to parts per million by weight of active ingredient.

The Poly(oxyalkylene) Amine

The poly(oxyalkylene) amine component of the present fuel composition is a poly(oxyalkylene) amine having at least one basic nitrogen atom and a sufficient number of oxyalkylene units to render the poly(oxyalkylene) amine soluble in hydrocarbons boiling in the gasoline or diesel range.

Generally, the poly(oxyalkylene) amines suitable for use in the present invention will contain at least about 5 oxyalkylene units, preferably from about 5 to 100, more preferably from about 8 to 100, and even more preferably from about 10 to 100. Especially preferred poly(oxyalkylene) amines will contain from about 10 to 25 oxyalkylene units.

The molecular weight of the presently employed poly(oxyalkylene) amines will generally range from about 500 to about 10000, preferably from about 500 to about 5000.

Suitable poly(oxyalkylene) amine compounds for use in the present invention include hydrocarbyl poly(oxyalkylene) polyamines as disclosed, for example, in U.S. Pat. No. 4,247,301, issued Jan. 27, 1981 to Honnen, the disclosure of which is incorporated herein by reference. These compounds are hydrocarbyl poly(oxyalkylene) polyamines wherein the poly(oxyalkylene) moiety comprises at least one hydrocarbyl-terminated poly(oxyalkylene) chain of from about 2 to 5 carbon atom oxyalkylene units, and wherein the poly(oxyalkylene) chain is bonded through a terminal carbon atom to a nitrogen atom of a polyamine having from about 2 to 12 amine nitrogen atoms and from about 2 to 40 carbon atoms with a carbon-to-nitrogen ratio between from about 1:1 and 10:1. The hydrocarbyl group on these hydrocarbyl poly(oxyalkylene) polyamines will contain from about 1 to 30 carbon atoms. These compounds generally have molecular weights in the range of about 500 to 10000, preferably from about 500 to 5000 and more preferably from about 800 to 5000.

The above-described hydrocarbyl poly(oxyalkylene) polyamines are prepared by conventional procedures known in the art, as taught, for example, in U.S. Pat. No. 4,247,301.

Other poly(oxyalkylene) amines suitable for use in the present invention are the poly(oxyalkylene) polyamines wherein the poly(oxyalkylene) moiety is connected to the polyamine moiety through an oxyalkylene hydroxy-type linkage derived from an epihalohydrin, such as epichlorohydrin or epibromohydrin. This type of poly(oxyalkylene) amine having an epihalohydrin-derived linkage is described, for example, in U.S. Pat. No. 4,261,704, issued Apr. 14, 1981 to Langdon, the disclosure of which is incorporated herein by reference.

Useful polyamines for preparing the epihalohydrin-derived poly(oxyalkylene) polyamines include, for example, alkylene polyamines, polyalkylene polyamines, cyclic amines, such as piperazines, and amino-substituted amines. The poly(oxyalkylene) polyamines having an epihalohydrin-derived linkage between the poly(oxyalkylene) and polyamine moieties are prepared using known procedures as taught, for example, in U.S. Pat. No. 4,261,704.

Another type of poly(oxyalkylene) amine useful in the present invention is a highly branched alkyl poly(oxyalkylene) monoamine as described, for example in U.S. Pat. No. 5,094,667, issued Mar. 10, 1992 to Schilowitz et al., the disclosure of which is incorporated herein by reference. These highly branched alkyl poly(oxyalkylene) monoamines have the general formula:

$$R_1—O—(C_4H_8O)_aCH_2CH_2CH_2NH_2$$

wherein $R_1$ is a highly branched alkyl group containing from about 12 to 40 carbon atoms, preferably an alkyl group having from about 20 carbon atoms which is derived from a Guerbet condensation reaction, and a is a number up to 30, preferably 4 to 8. The preferred alkyl group is derived from a Guerbet alcohol containing 20 carbon atoms having the formula:

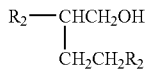

wherein $R_2$ is a hydrocarbyl chain.

The above highly branched alkyl poly(oxyalkylene) monoamines are prepared by using known methods as disclosed, for example, in U.S. Pat. No. 5,094,667.

A preferred class of poly(oxyalkylene) amine for use in the fuel composition of the present invention are hydrocarbyl poly(oxyalkylene) monoamines as described, for example, in U.S. Pat. No. 5,112,364, issued May 12, 1992 to Rath et al., the disclosure of which is incorporated herein by reference. As disclosed in U.S. Pat. No. 5,112,364, such poly(oxyalkylene) monoamines may be prepared by the reductive amination of a phenol-initiated or alkylphenol-initiated poly(oxyalkylene) alcohol with ammonia or a primary amine.

In addition, the above-mentioned U.S. Pat. No. 4,247,301 to Honnen discloses hydrocarbyl poly(oxyalkylene) monoamines which are suitable for use in the present fuel composition. In particular, Example 6 of this patent describes alkylphenyl poly(oxyalkylene) monoamines prepared from ammonia and dimethylamine.

A particularly preferred type of hydrocarbyl poly(oxyalkylene) monoamine is an alkylphenyl poly(oxyalkylene) monoamine wherein the poly(oxyalkylene) moiety contains oxypropylene units or oxybutylene units or mixtures of oxypropylene and oxybutylene units. Preferably. The poly (oxyalkylene) moiety contains oxybutylene. Preferably, the alkyl group on the alkylphenyl moiety is a straight or branched-chain alkyl of from about 1 to 24 carbon atoms. An especially preferred alkylphenyl moiety is tetrapropenylphenyl, that is, where the alkyl group is a branched-chain alkyl of 12 carbon atoms derived from propylene tetramer.

The Thiadiazole Compound

The thiadiazole compound employed in the present invention will typically have the following general formula:

(I)

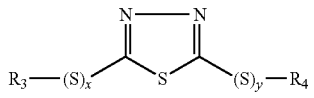

wherein x and y are independently integers from about 1 to 8 and $R_3$ and $R_4$ are independently H or $C_1$ to $C_{50}$ hydrocarbyl. Preferably, x and y are independently integers from about 1 to 2 and $R_3$ and $R_4$ are independently H or $C_1$ to $C_{30}$ hydrocarbyl. Most preferably, x is 2, y is 1, $R_3$ is a $C_1$ to $C_{20}$ hydrocarbyl group, and $R_4$ is H. Preferably, the hydrocarbyl group is an alkyl group.

Preferred thiadiazole compositions contemplated for use in the present invention include 2,5-dimercapto-1,3,4 thiadiazole, 2-mercapto-5-hydrocarbylthio-1,3,4-thiadiazole, 2,5-bis (hydrocarbylthio)-1,3,4-thiadiazole, 2-mercapto-5-hydrocarbyldithio-1,3,4-thiadiazole, 2,5-bis(hydrocarbyldithio)-1,3,4-thiadiazole and mixtures thereof. These compounds have the structural formulas shown below:

(II)

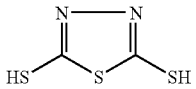

2,5-dimercapto-1,3,4-thiadiazole (III)

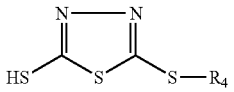

2-mercapto-5-hydrocarbylthio-1,3,4-thiadiazole (IV)

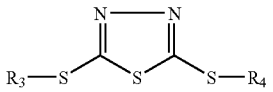

2,5-bis(hydrocarbylthio)-1,3,4-thiadiazole (V)

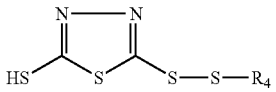

2-mercapto-5-hydrocarbyldithio-1,3,4-thiadiazole (VI)

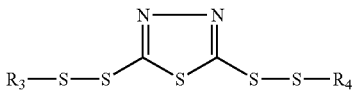

2,5-bis(hydrocarbyldithio)-1,3,4-thiadiazole wherein $R_3$ and $R_4$ are as defined above.

Preferred thiadiazoles include alkyl thiothiadiazoles and alkyl dithiothiadiazoles, such as those commercially available from Ethyl Corporation as "ETHYL HITEC" and Baker-Petrolite "TOLAD 9719".

Fuel Compositions

The fuel additive composition utilized in the present invention will generally be employed in hydrocarbon fuels to rectify fuel gauge sending unit problems, particularly silver-based fuel gauge sending units, in vehicle fuel storage tanks. The proper concentration of additive necessary to either preclude fuel gauge sending units from sustaining sulfur-related corrosion damage or restore fuel gauge sending units to like-new operational condition depends upon the type of fuel employed and severity of the problem. The benefit of the treatment can persist in protecting fuel gauge sending units for up to 12000 miles of vehicle driving after one initial one-tankful treatment.

Generally, the present fuel additive composition will be employed in a hydrocarbon fuel in a concentration ranging from about 2100 to 10250 parts per million (ppm) by weight, preferably from 2100 to 5000 ppm/w, and more preferably from about 2100 to 3500 ppm/w.

In terms of individual components, hydrocarbon fuel containing the fuel additive composition of this invention will generally contain from about 2000 to 10000 ppm by weight, preferably from about 2000 to 5000 ppm/w, more preferably from about 2000 to 4000 ppm/w, of the poly(oxyalkylene) amine component and from about 10 to 250 ppm by weight, preferably from about 20 to 200 ppm/w, more preferably from about 20 to 100 ppm/w, of the thiadiazole component.

The fuel additive composition employed in the present invention is preferably formulated as a concentrate using an inert stable oleophilic (i.e., dissolves in gasoline) organic solvent boiling in the range of from about 150° F. to 400° F. (from about 65° C. to 205° C.). Preferably, an aliphatic or an aromatic hydrocarbon solvent is used, such as benzene, toluene, xylene or higher-boiling aromatics or aromatic thinners. Aliphatic alcohols containing from about 3 to 8 carbon atoms, such as isopropanol, isobutylcarbinol, n-butanol and the like, in combination with hydrocarbon solvents are also suitable for use with the present additives. In the concentrate, the amount of the additive composition will generally range from about 10 to about 70 weight percent, preferably from about 10 to 50 weight percent, more preferably from about 20 to 40 weight percent.

In gasoline fuels, other fuel additives may be employed with the additive composition employed in the present invention, including, for example, oxygenates, such as t-butyl methyl ether, antiknock agents, such as methylcyclopentadienyl manganese tricarbonyl, and other dispersants/detergents, such as hydrocarbyl amines, or succinimides. Additionally, antioxidants, metal deactivators, demulsifiers and carburetor or fuel injector detergents may be present.

In diesel fuels, other well-known additives can be employed, such as pour point depressants, flow improvers, cetane improvers, and the like.

A fuel-soluble, nonvolatile carrier fluid or oil may also be used with the fuel additive composition employed in the present invention. The carrier fluid is a chemically inert hydrocarbon-soluble liquid vehicle which substantially increases the nonvolatile residue (NVR), or solvent-free liquid fraction of the fuel additive composition while not overwhelmingly contributing to octane requirement increase. The carrier fluid may be a natural or synthetic fluid, such as mineral oil, refined petroleum oils, synthetic polyalkanes and alkenes, including hydrogenated and unhydrogenated polyalphaolefins, and synthetic poly(oxyalkylene)-derived fluids, such as those described, for example, in U.S. Pat. No. 4,191,537 to Lewis et al, and polyesters, such as those described, for example, in U.S. Pat. No. 3,756,793 to Robinson and U.S. Pat. No. 5,004,478 to Vogel et al., and in European Patent Application Nos. 356,726, published Mar. 7, 1990, and 382,159, published Aug. 16, 1990.

These carrier fluids are believed to act as a carrier for the fuel additive composition employed in the present invention.

The carrier fluids are typically employed in amounts ranging from about 25 to about 5000 ppm by weight of the hydrocarbon fuel, preferably from 100 to 3000 ppm of the fuel. Preferably, the ratio of carrier fluid to fuel additive composition will range from about 0.2:1 to about 10:1, more preferably from about 0.5:1 to 3:1.

When employed in a fuel concentrate, carrier fluids will generally be present in amounts ranging from about 20 to 60 weight percent, preferably from about 30 to 50 weight percent.

EXAMPLES

The invention will be further illustrated by the following examples, which set forth particularly advantageous method embodiments. While the Examples are provided to illustrate the present invention, they are not intended to limit it.

The following designations will apply throughout the Examples unless noted to the contrary:

Additive A: Base fuel containing severe sulfur package plus $C_{12}$ alkylphenoxy poly(oxybutylene) amine prepared by the reductive amination of a $C_{12}$ alkylphenoxy poly(oxybutylene) alcohol having an average molecular weight of about 1600.

Additive B: Base fuel containing severe sulfur package plus alkyl dithiothiadiazole (Baker-Petrolite Tolad 9719)

Example 1

Four test vehicles were driven for two full tankfuls of a very sulfur-severe gasoline while simultaneously being additized with the respective test package as described below.

Testing was accomplished in four MY (Model Year) 1998 Chevrolet Lumina vehicles having the engine specifications shown in Table 1:

TABLE 1

| MY1998 Chevrolet Lumina Engine Specifications | |
|---|---|
| Bore (mm): | 89.0 |
| Stroke (mm): | 84.0 |
| Displacement ($cm^3$): | 3100 |
| Compression Ratio: | 9.5:1 |

The base test gasoline used in the four vehicles was a commercial California premium unleaded gasoline (no oxygenate) with the properties listed in Table 2. The test fuel used in all four vehicles also contained a severe sulfur dirty-up package added to the gasoline to enhance test severity. The severe sulfur package contained 16 ppm of elemental sulfur and 20 ppm of mercaptan sulfur. Each vehicle, except the control, contained an additive package in addition to the severe sulfur package; the one control vehicle fuel and the three additized fuels are here named Fuel 1, Fuel 2, Fuel 3, and Fuel 4. The fuels are defined in Table 3. The four test vehicles were driven on a prescribed city-suburban test cycle for two complete tankfuls of the respective test fuel before being assessed.

TABLE 2

| Base California Premium Unleaded Test Gasoline | | |
|---|---|---|
| Regular FIAM (ASTM D1319) | | |
| Aromatics: | 22.500 | vol % |
| Olefins: | 12.000 | vol % |
| Saturates: | 65.500 | vol % |
| Unwashed gum: | 34.000 | mg/100 ml |
| Washed gum: | 1.000 | mg/100 ml |
| Oxidative Stability: | 24.000 | hours |
| T90 (ASTM D86): | 308.3° | F. |
| Reid Vapor Pressure (RVP): | 7.010 | psi |
| Sulfur: | <6 | ppm/w |

TABLE 3

| Test Fuel Description | |
|---|---|
| Fuel 1: | Unadditized base fuel with severe sulfur package. |
| Fuel 2: | Base fuel containing severe sulfur package plus $C_{12}$ alkylphenoxy poly(oxybutylene) amine prepared by the reductive amination of a $C_{12}$ alkylphenoxy poly(oxybutylene) alcohol having an average molecular weight of about 1600 (Additive A, 3000 ppm/w). |
| Fuel 3: | Base fuel containing severe sulfur package plus alkyl dithiothiadiazole (Baker-Petrolite Tolad 9719) (Additive B, 36 ppm/w). |
| Fuel 4: | Base fuel containing severe sulfur package plus $C_{12}$ alkylphenoxy poly(oxybutylene) amine (3000 ppma/w) + an alkyl dithiothiadiazole (Baker-PetroliteTolad 9719) (36 ppm/w). |

At the completion of two full tankfuls of test fuel, the respective vehicle's fuel gauge sending unit signal was recorded and analyzed. Twenty minute trace recordings were accomplished by first re-filling the tanks with clean test fuel (unadditized with no severe sulfur package added), then recording the drain sequence to the empty tank point. The clean gasoline used had the properties described in Table 2. The tank was drained by a pump external to the vehicle. The respective fuel gauge sending unit's analog voltage signal was recorded during the drain sequence using a TEAC RD130TE digital audio tape technology recorder; the analog signal digital sample rate was 48000 samples per second. The recorder's TEAC QUIK-VU data analysis software package was used to quantify the electrical analog waveform. The software provided both the waveform's AC-coupled (the waveform DC component is subtracted out) RMS voltage value (root-mean-square: the square root of the sum of the squares of all sample points, divided by the number of samples taken), and the maximum and minimum voltage value attained over time by the waveform. The voltage magnitude difference between the maximum and minimum value is here referred to as the maximum-minimum delta voltage value. On a trace recording, the greater the value of the AC-coupled RMS voltage or the greater the value of the maximum-minimum delta voltage, the more corrupted is the sending unit signal by surface contamination.

The data is summarized in Table 4; the percent reduction number shown is with respect to the control case (Fuel 1). Surprisingly, the percent RMS voltage reduction seen is greatest for Fuel 4, showing a synergism between the two components in the Fuel 4 package. Likewise, the same synergism is observed in the maximum-minimum delta voltage in Fuel 4; in this case, Fuel 4 shows a 5-6% reduction improvement compared to Fuel 2 and Fuel 3 which contained the two additive components of Fuel 4 individually and not combined.

TABLE 4

| Fuel Gauge Sending Unit Clean-Up Data | | | | |
|---|---|---|---|---|
| Fuel | RMS (V) | Reduction (%)* | Max/Min Delta (V) | Reduction (%) |
| 1 | 0.529 | | 3.327 | |
| 2 | 0.392 | 25.9 | 2.617 | 21.3 |
| 3 | 0.390 | 26.3 | 2.662 | 20.0 |
| 4 | 0.371 | 29.9 | 2.461 | 26.0 |

*With respect to the control value.

The results of the test above indicate that sulfur-related corrosion damage may be precluded in silver-based fuel gauge sending units when the fuel additive composition of the present invention having a high concentration of a combination of a poly(oxyalkylene) amine (Additive A, 3000 ppm/w) and a thiadiazole compound (Additive B, 36 ppm/w) is employed as a fuel additive in vehicle fuel storage tanks.

Example 2

A MY2000 Ford Expedition fuel gauge sending unit was restored to like-new condition after driving for two full tankfuls of a high concentration of a combination of a poly(oxyalkylene) amine (Additive A, 3000 ppm/w) and a thiadiazole compound (Additive B, 36 ppm/w) in a clean-up test. Prior to the treatment, the fuel level gauge was erratic and read artificially high. Engine specifications for the MY2000 Ford Expedition are shown in Table 5. The base test gasoline used for the "clean-up" test was a California premium unleaded gasoline containing no oxygenate; its properties are described in Table 6. Prior to starting the two tankful additized clean-up test, the vehicle's fuel gauge sending unit electrical analog signal was recorded and analyzed. A one hour trace recording was accomplished by first re-filling the tank with clean test fuel (unadditized), then recording the drain sequence to the empty tank point. The clean gasoline used had the properties described in Table 6. The tank was drained by a pump external to the vehicle. The respective fuel gauge sending unit's analog voltage signal was recorded during the drain sequence using a TEAC RD130TE digital audio tape technology recorder; the analog signal digital sample rate was 48000 samples per second. The recorder's TEAC QUIK-VU data analysis software package was used to quantify the electrical analog waveform. The software provided both the waveform's AC-coupled (the waveform DC component is subtracted out) RMS voltage value (root-mean-square: the square root of the sum of the squares of all sample points, divided by the number of samples taken), and the maximum and minimum voltage value attained over time by the waveform. The voltage magnitude difference between the maximum and minimum value is here referred to as the maximum-minimum delta voltage value. On a trace recording, the greater the value of the AC-coupled RMS voltage or the greater the value of the maximum-minimum delta voltage, the more corrupted is the sending unit signal by surface contamination.

Once the vehicle's fuel gauge sending unit signal was initially recorded, the vehicle was then driven on the additized test fuel for two full tankfuls. At the completion of two full tankfuls of the additized test fuel, the vehicle's fuel gauge sending unit signal was again recorded and analyzed in the same manner as described above prior to starting the test. This fuel gauge sending unit signal recording was compared to the recording done initially before starting the additized clean-up. On a trace recording, the greater the value of the AC-coupled RMS voltage or the greater the value of the maximum-minimum delta voltage, the more corrupted is the sending unit signal by surface contamination.

The results are summarized in Table 7; the fuel gauge sending unit was restored to a normal operating condition in two full tankfuls of the additized gasoline. The results were very surprising and unexpected, and show dramatic restoration of the fuel gauge sending unit to operationally normal condition.

TABLE 5

| MY2000 Ford Expedition Engine Specifications | |
|---|---|
| Bore (mm): | 90.2 |
| Stroke (mm): | 90.0 |
| Displacement ($cm^3$): | 4600 |
| Compression Ratio: | 9.0:1 |

TABLE 6

| Base California Premium Unleaded Test Gasoline | |
|---|---|
| Regular FIAM (ASTM D1319) | |
| Aromatics: | 22.500 vol % |
| Olefins: | 12.000 vol % |
| Saturates: | 65.500 vol % |
| Unwashed gum: | 34.000 mg/100 ml |
| Washed gum: | 1.000 mg/100 ml |
| Oxidative Stability: | 24.000 hours |
| T90 (ASTM D86): | 308.3° F. |
| Reid Vapor Pressure (RVP) | 7.010 psi |
| Sulfur: | <6 ppm/w |

TABLE 7

Ford Expedition Fuel Gauge Sending Unit Clean-Up Data
One-Hour Fuel Gauge Sending Unit Analog Voltage Trace Data

| | RMS (V) | Reduction (%)* | Max/Min Delta (V) | Reduction (%) |
|---|---|---|---|---|
| Start of Test | 0.356 | | 3.146 | |
| End of Test | 0.317 | 11.0 | 1.323 | 57.9 |

*With respect to the start of test value.

The results indicated that prior to the treatment, the fuel level gauge was erratic and read artificially high. After treatment, the fuel level gauge was restored to normal operating condition as evidenced by the data shown in Table 7. These results are both surprising and unexpected.

Example 3

Two MY1998 Chevrolet Lumina vehicles were first dosed with additive concentrate (first and only dose), and then driven together for 12000 miles on a marketplace moderately severe commercial premium unleaded gasoline. Engine specifications for the two test vehicles are listed in Table 8. The base test gasoline used was the same gasoline as is described in Table 9; additionally, elemental sulfur at 1 ppm was added to this gasoline in order to enhance test corrosion scale and replicate a marketplace moderately sulfur-severe fuel.

At the start of the test, one vehicle was initially dosed for one full tankful with poly(oxyalkylene) amine (Additive A, 3000 ppma/w) alone. This is referred to here as Fuel 5. The other vehicle was dosed for one full tankful with a high concentration of a combination of a poly(oxyalkylene) amine (Additive, 3000 ppma/w) and a thiadiazole compound (Additive B, 36 ppm/w). This is referred to as Fuel 6. This is the only time during the test that either vehicle was additized with the concentrate. Fuel 5 and Fuel 6 are described in Table 10. The vehicles were then driven together for 12000 miles over a prescribed road course, at which point the test was terminated.

TABLE 8

| MY1998 Chevrolet Lumina Engine Specifications | |
|---|---|
| Bore (mm): | 89.0 |
| Stroke (mm): | 84.0 |
| Displacement ($cm^3$): | 3100 |
| Compression Ratio: | 9.5:1 |

TABLE 9

| Base California Premium Unleaded Test Gasoline | |
|---|---|
| Regular FIAM (ASTM D1319) | |
| Aromatics: | 22.500 vol % |
| Olefins: | 12.000 vol % |
| Saturates: | 65.500 vol % |
| Unwashed gum: | 34.000 mg/100 ml |
| Washed gum: | 1.000 mg/100 ml |
| Oxidative Stability: | 24.000 hours |
| T90 (ASTM D86): | 308.3° F. |
| Reid Vapor Pressure (RVP): | 7.010 psi |
| Sulfur: | <6 ppm/w |

TABLE 10

| Start of Test One-tankful Additized Fuel Description | |
|---|---|
| Fuel 5: | Additive A (3000 ppm/w). |
| Fuel 6: | Additive A (3000 ppm/w) + Additive B (Baker-Petrolite Tolad 9719) (36 ppm/w). |

Four silver and four copper coupons were affixed to a stainless steel tray which was placed submerged at the bottom of each vehicle's fuel tank. Each coupon was electrically isolated from the tray and from each other. The silver coupons were rated and prepared as per specification IP227/82 (Silver Strip Corrosion Test). All silver coupons were prepared by this method and rated using the "Silver Strip Classification" rating scale shown in Table 12. For the silver rating numbers, "0" is no tarnish while "4" shows blackening. The copper coupons were rated as per specification ASTM D130, using the "Copper Strip Corrosion Standard" shown in Table 13; this standard is a plaque of copper strips which show visually the rating numbers and the respective copper strip discoloration that relates to each number. On this scale, the cleanest rating is 1A (little or no tarnish) and the most tarnished rating is 4C (blackening). The characteristics of the coupons used are given in Table 11.

TABLE 11

| Characteristics of the Square Silver and Copper Test Coupons | |
|---|---|
| Length and Width: | 0.75 inches |
| Thickness: | 0.032 inches |
| Copper purity: | 99.9% pure |

TABLE 11-continued

| Characteristics of the Square Silver and Copper Test Coupons | |
|---|---|
| (made in accordance with ASTM B370) | |
| Silver purity: (MIL-S-13282) | 99.9% pure |

TABLE 12

Definitions of Silver Coupon Rating Numbers

| Classification | Designation | Description |
|---|---|---|
| 0 | No Tarnish | The same as freshly polished strip except possibly for some very slight loss of luster. |
| 1 | Slight Tarnish | Faint brown or white discoloration of strip (see note below) |
| 2 | Moderate | Tarnish Peacock colors such as blue or mauve or medium/dark straw brown coloration (see note below) |
| 3 | Slight Blackening | Spots and patches of black or grey on surface or uniform thin film of black deposit |
| 4 | Blackening | Uniform heavy blackening with or without scaling |

Note:
The ASTM or CRC color Standard for the Thermal Stability of Turbine Fuel (ASTM D-12660) should be used to differentiate between the brown colorations mentioned in classifications 1 and 2. Any brown coloration less than ASTM or CRC No. 4 should be rated classification 1.

TABLE 13

Definitions of Copper Coupon Rating Numbers
ASTM D130-04: Copper Strip Classifications

| Classification | Designation | Description[1] |
|---|---|---|
| Freshly polished strip[2] | | |
| 1 | slight tarnish | a. Light orange, almost the same as freshly polished strip |
| | | b. Dark orange |
| 2 | moderate tarnish | a. Claret red |
| | — | b. Lavender |
| | — | c. Multicolored with lavender blue or silver or both, overlaid on claret red |
| | — | d. Silvery |
| | — | e. Brassy or gold |
| 3 | dark tarnish | a. Magenta overcast on brassy strip |
| | — | b. Multicolored with red and green showing (peacock), but no gray |
| 4 | corrosion | a. Transparent black, dark gray or brown with peacock green barely showing |
| | | b. Graphite or lusterless black |
| | | c. Glossy or jet black |

[1]The ASTM Copper Strip Corrosion Standard is a colored reproduction of strips characteristic of these descriptions.
[2]The freshly polished strip is included in the series only as an indication of the appearance of a properly polished strip before a test run; it is not possible to duplicate this appearance after a test even with a completely noncorrosive sample.

As the vehicles were driven on test, the coupons were extracted and rated every 2000 miles. The coupon ratings at the 6000 mile inspection point are submitted and summarized in Table 14. Coupons from the vehicle initially dosed with additized Fuel 5 are seen to be badly tarnished whereas the coupons from the vehicle initially additized with Fuel 6 are seen to be bright and lustrous. This is very surprising and unexpected, and shows Fuel 6 providing corrosion protection to the silver and copper coupons after nearly 6000 miles from the initial one-tankful exposure to Fuel 6. In Table 14, the silver rating number for Fuel 6 of "0" is no tarnish while Fuel 5 is moderately tarnish (2); likewise, for the copper coupons, Fuel 6 is rated as "1A" (little or no tarnish) while Fuel 5 is rated "1B" (dark orange).

TABLE 14

Silver and Copper Coupon Ratings at 6000 Miles

| | Silver Coupon | | | | Copper Coupon | | | |
|---|---|---|---|---|---|---|---|---|
| Fuel | A | B | C | D | E | F | G | H |
| 5 | 3 | 3 | 3 | 3 | 1B | 1B | 1B | 1B |
| 6 | 0 | 0 | 0 | 0 | 1A | 1A | 1A | 1A |

Additionally, the fuel gauge sending unit analog voltage signal was recorded at each 2000 mile inspection point. Twenty minute trace recordings were accomplished by first re-filling the tanks with clean test fuel, then recording the drain sequence to the empty tank point. The clean gasoline used had the properties described in Table 9. The tank was drained by a pump external to the vehicle. The respective fuel gauge sending unit's analog voltage signal was recorded during the drain sequence using a TEAC RD130TE digital audio tape technology recorder; the analog signal digital sample rate was 48000 samples per second. The recorder's TEAC QUIK-VU data analysis software package was used to quantify the electrical analog waveform. The software provided both the waveform's AC-coupled (the waveform DC component is subtracted out) RMS voltage value (root-mean-square: the square root of the sum of the squares of all sample points, divided by the number of samples taken), and the maximum and minimum voltage value attained over time by the waveform. The voltage magnitude difference between the maximum and minimum value is here referred to as the maximum-minimum delta voltage value.

The fuel gauge sending unit signal recording and analysis data at the 12000 mile inspection is summarized in Table 15; the percent reduction number shown is for the Fuel 6 values with respect to the Fuel 5 values. On a trace recording, the greater the value of the AC-coupled RMS voltage or the greater the value of the maximum-minimum delta voltage, the more corrupted is the sending unit signal by surface contamination. These results are very surprising and unexpected, and demonstrates that the Fuel 6 can protect and maintain in normal condition fuel gauge sending units from sulfur corrosion for over 12000 miles with one application.

TABLE 15

Fuel 6 Persistence at 12000 Miles
20-Minute Fuel Gauge Sending Unit Analog Trace Data

| | RMS (V) | Reduction (%)* | Max/Min Delta (V) | Reduction (%) |
|---|---|---|---|---|
| Fuel 5 | 0.505 | | 3.203 | |
| Fuel 6 | 0.397 | 21.4 | 2.668 | 16.7 |

*With respect to the Fuel 5 value.

As the results of Example 3 show, the high concentration of a combination of a poly(oxyalkylene) amine (Additive A, 3000 ppm/w) and a thiadiazole compound (Additive B, 36 ppm/w) persisted for over 12000 miles in protecting the fuel gauge sending unit from sulfur-related corrosion. Additionally, silver and copper coupons placed in the gasoline tank remained bright and lustrous for over 6000 miles in the vehicle with the combination, while vehicle dosed initially with the poly(oxyalkylene) amine alone showed slightly blackened and tarnished coupons at 6000 miles. These results are surprising and unexpected.

Example 4

High concentrations (3000 ppm/w) of the poly(oxyalkylene) amine (Additive A) employed in the present invention can by itself restore sulfur-corrosion damaged fuel gauge sending units to normal operating condition. This is surprising and unexpected because traditional deposit control additives or additive concentrates have never before been shown to effectively keep clean or cleanup non-carbonaceous deposits. However, only the high concentration of a combination of a poly(oxyalkylene) amine (Additive A, 3000 ppm/w) and a thiadiazole compound (Additive B, 36 ppm/w) can preclude the sulfur corrosion problem from happening and provide long term prophylaxis as described in Example 3.

Five MY1998 Chevrolet Lumina vehicles were first exposed to severe fuel system sulfur contamination, causing fuel gauge sending unit failure. Four of the vehicles (here named Vehicle 1, Vehicle 2, Vehicle 3, and Vehicle 4) were then dosed with poly(oxyalkylene) amine (Additive A, 3000 ppm/w) for one full tankful and one vehicle (here named Vehicle 5) was dosed with poly(oxyalkylene) amine (Additive A) at 192 ppm/w in order to demonstrate restoration of the fuel gauge sending unit signal. Vehicle 5 was dosed with poly(oxyalkylene) amine at a much lower concentration than Vehicles 1-4 in order to demonstrate that complete restoration of the fuel sending units requires the higher concentrate dosage of poly(oxyalkylene) amine. The engine specifications of the test vehicles used is given in Table 16. The base test gasoline used in the vehicles was a commercial California regular unleaded gasoline (no oxygenate) with the properties listed in Table 17 (note that this base test gasoline contained no commercial deposit control additive; this accounts for the low unwashed gums number in Table 17). The dirty-up test fuel also contained a severe sulfur package added to the gasoline in order to enhance test severity. This severe sulfur package contained 16 ppm of elemental sulfur and 20 ppm of mercaptan sulfur. For the dirty-up sequence, the test vehicles were driven on a prescribed city-suburban test cycle for two complete tankfuls of the severe test fuel. Prior to starting the one-tank clean-up using poly(oxyalkylene) amine, the respective vehicle's fuel gauge sending unit analog voltage signal was recorded and analyzed. Twenty minute fuel gauge sending unit trace recordings were accomplished by first refilling the tanks with clean test fuel (the same gasoline described in Table 17 but with no severe sulfur package added), then recording the tank drain sequence to an empty tank level. The tank was drained by a pump external to the vehicle. The fuel gauge sending unit's analog voltage signal was recorded during the drain sequence using a TEAC RD130TE digital audio tape technology recorder; the analog signal digital sample rate was 48,000 samples per second. The recorder's TEAC QUIK-VU data analysis software package was used to quantify the electrical analog waveform. The software provided both the waveform's AC-coupled (the waveform DC component is subtracted out) RMS voltage value (root-mean-square: the square root of the sum of the squares of all sample points, divided by the number of samples taken), and the maximum and minimum voltage value attained over time by the waveform. The voltage magnitude difference between the maximum and minimum value is here referred to as the maximum-minimum delta voltage value. On a trace recording, the greater the value of the AC-coupled RMS voltage or the greater the value of the maximum-minimum delta voltage, the more corrupted is the sending unit signal by surface contamination.

After these initial start of clean-up recordings, each vehicle was driven for one full tankful of regular unleaded gasoline (described in Table 17) with poly(oxyalkylene) amine (Additive A, 3000 ppma/w). At the completion of this tankful of poly(oxyalkylene) amine twenty minute fuel gauge sending unit trace recordings were again accomplished by first refilling the tanks with clean test fuel (the same gasoline described in Table 17 but with no severe sulfur package added), then recording the drain sequence to an empty tank level. The fuel gauge sending unit analog recording data is summarized in Table 18. The data shows that, in all four test cases, an erratic fuel gauge sending unit signal giving false fuel level indications on the vehicle's fuel gauge is restored to normal operating condition by the use of one tankful of poly (oxyalkylene) amine concentrate. On a trace recording, the greater the value of the AC-coupled RMS voltage or the greater the value of the maximum-minimum delta voltage, the more corrupted is the sending unit signal by surface contamination.

TABLE 16

MY1998 Chevrolet Lumina Engine Specifications

| | |
|---|---|
| Bore (mm): | 89.0 |
| Stroke (mm): | 84.0 |
| Displacement ($cm^3$): | 3100 |
| Compression Ratio: | 9.5:1 |

TABLE 17

Base Regular Unleaded Test Gasoline

| Regular FIAM (ASTM D1319) | | |
|---|---|---|
| Aromatics: | 32.00 | vol % |
| Olefins: | 8.30 | vol % |
| Saturates: | 59.70 | vol % |
| Unwashed gum: | 2.00 | mg/100 ml |
| Washed gum: | 1.000 | mg/100 ml |
| Oxidative Stability: | 24.000 | hours |
| T90 (ASTM D86): | 351.1° | F. |
| Reid Vapor Pressure (RVP): | 11.64 | psi |
| Sulfur: | 20 | ppm/w |

TABLE 18

Fuel Gauge Sending Unit Clean-Up in Four Chevrolet Lumina Vehicles With Poly(oxyalkylene) Amine

| | | RMS (V) | Reduction* | Max/Min Delta (V) | Reduction* |
|---|---|---|---|---|---|
| Vehicle 1 | SOT | 0.452 | | 2.886 | |
| | EOT | 0.352 | 22.1% | 1.248 | 56.8% |
| Vehicle 2 | SOT | 0.451 | | 3.062 | |
| | EOT | 0.368 | 18.4% | 1.298 | 57.6% |
| Vehicle 3 | SOT | 0.431 | | 2.821 | |
| | EOT | 0.355 | 17.6% | 1.361 | 51.8% |
| Vehicle 4 | SOT | 0.461 | | 2.747 | |
| | EOT | 0.369 | 20.0% | 1.371 | 50.1% |
| Vehicle 5 | SOT | 0.462 | | 2.029 | |
| | EOT | 0.424 | 8.2% | 1.673 | 17.5% |

*With respect to the SOT value.
20-Minute Fuel Gauge Sending Unit Analog Voltage Trace Data
SOT = Start of Test
EOT = End of Test Example 4 demonstrates that poly(oxyalkylene) amine concentrate by itself restores erratically operating fuel gauge sending units to normal operation. This is surprising and unexpected because traditional deposit control additives or additive concentrates have never before been shown to effectively keep-clean or clean-up non-carbonaceous deposits on fuel gauge sending units in a vehicle fuel storage tank.

What is claimed is:

1. A fuel composition comprising a major amount of hydrocarbons boiling in the gasoline or diesel range and:

a) about 2000 to 10000 ppm by weight of a hydrocarbyl poly(oxyalkylene) polyamine or a hydrocarbyl poly (oxyalkylene) monoamine, wherein the hydrocarbyl poly(oxyalkylene) polyamine or hydrocarbyl poly(oxyalkylene) monoamine has at least one basic nitrogen atom and a sufficient number of oxyalkylene units to render the poly(oxyalkylene) amine soluble in hydrocarbons boiling in the gasoline or diesel fuel range and a molecular weight of from about 500 to about 10000, and b) about 10 to 250 ppm by weight of a thiadiazole compound having the formula:

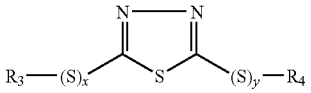

wherein x and y are independently integers from about 1 to about 8 and $R_3$ and $R_4$ are independently H or $C_1$ to $C_{50}$ hydrocarbyl.

2. The fuel composition according to claim 1, wherein said hydrocarbyl poly(oxyalkylene) polyamine or hydrocarbyl poly(oxyalkylene) monoamine contains at least about 5 oxyalkylene units.

3. The fuel composition according to claim 1, wherein said hydrocarbyl poly(oxyalkylene) polyamine or hydrocarbyl poly(oxyalkylene) monoamine contains from about 5 to about 100 oxyalkylene units.

4. The fuel composition according to claim 1, wherein said hydrocarbyl poly(oxyalkylene) polyamine or hydrocarbyl poly(oxyalkylene) monoamine contains from about 10 to about 100 oxyalkylene units.

5. The fuel composition according to claim 1, wherein said hydrocarbyl poly(oxyalkylene) polyamine or hydrocarbyl poly(oxyalkylene) monoamine contains from about 10 to about 25 oxyalkylene units.

6. The fuel composition according to claim 5, wherein said fuel composition comprises a hydrocarbyl poly(oxyalkylene) monoamine.

7. The fuel composition according to claim 6, wherein the hydrocarbyl group of said hydrocarbyl poly(oxyalkylene) monoamine contains from about 1 to 30 carbon atoms.

8. The fuel composition according to claim 7, wherein said hydrocarbyl group of said hydrocarbyl poly(oxyalkylene) monoamine is an alkylphenyl group.

9. The fuel composition according to claim 8, wherein said hydrocarbyl poly(oxyalkylene) monoamine is an alkylphenyl poly(oxyalkylene) monoamine, wherein the poly(oxyalkylene) moiety contains oxypropylene units or oxybutylene units or mixtures thereof.

10. The fuel composition according to claim 9, wherein said hydrocarbyl poly(oxyalkylene) monoamine is an alkylphenyl poly(oxyalkylene) monoamine, wherein the poly (oxyalkylene) moiety contains oxybutylene units.

11. The fuel composition according to claim 10, wherein the alkyl moiety of said alkylphenyl group is tetrapropenyl.

12. The fuel composition according to claim 1, wherein x and y are independently integers from about 1 to 2 and $R_3$ and $R_4$ are independently H or $C_1$ to $C_{30}$ hydrocarbyl.

13. The fuel composition according to claim 12, wherein x is 2, y is 1, $R_3$ is a $C_1$ to $C_{20}$ hydrocarbyl group and isomers thereof, and $R_4$ is H.

14. The fuel composition according to claim 13, wherein the hydrocarbyl group is alkyl.

15. The fuel composition according to claim 1, wherein the thiadiazole is alkyl thiothiadiazole or alkyl dithiothiadiazole.

16. The fuel composition according to claim 15, wherein the thiadiazole is an alkyl dithiothiadiazole.

17. A method of precluding silver-based fuel gauge sending units from sustaining sulfur-related corrosion damage or restoring silver-based fuel gauge sending units in gasoline or diesel vehicle fuel storage tanks to like-new operational condition, said method comprising operating a gasoline or diesel engine vehicle with a fuel composition comprising a major amount of hydrocarbons boiling in the gasoline or diesel range and:

a) about 2000 to 10000 ppm by weight of a hydrocarbyl poly(oxyalkylene) polyamine or hydrocarbyl poly(oxyalkylene) monoamine, wherein the hydrocarbyl poly (oxyalkylene) polyamine or hydrocarbyl poly(oxyalkylene) monoamine has at least one basic nitrogen atom and a sufficient number of oxyalkylene units to render the poly(oxyalkylene) amine soluble in hydrocarbons boiling in the gasoline or diesel fuel range and a molecular weight of from about 500 to about 10000, and b) about 10 to 250 ppm by weight of a thiadiazole compound having the formula:

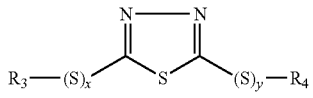

wherein x and y are independently integers from about 1 to about 8 and $R_3$ and $R_4$ are independently H or $C_1$ to $C_{50}$ hydrocarbyl.

* * * * *